US005662303A

United States Patent [19]

Rellinger et al.

[11] Patent Number: 5,662,303

[45] Date of Patent: Sep. 2, 1997

[54] PORTABLE EASEL HAVING A HOLLOW BODY

[75] Inventors: Michael Rellinger, Chicago; Richard R. Gilbert, Barrington; Sara E. Green, Chicago; John Jepsen, Grayslake, all of Ill.

[73] Assignee: Quartet Manufacturing Company, Skokie, Ill.

[21] Appl. No.: 579,047

[22] Filed: Dec. 22, 1995

Related U.S. Application Data

[63] Continuation of Ser. No. 74,773, Jun. 9, 1993, Pat. No. 5,478,040.

[51] Int. Cl.[6] ..... A47B 97/04

[52] U.S. Cl. ..... 248/448; 248/460

[58] Field of Search ..... 248/448, 455, 248/456, 460, 441.1, 452, 463, 150, 423

[56] References Cited

U.S. PATENT DOCUMENTS

| | | | |
|---|---|---|---|
| 396,362 | 1/1889 | Marks | 248/499 |
| 2,912,203 | 11/1959 | Townsend | 248/448 |
| 3,095,666 | 7/1963 | Killen | 248/449 |
| 3,195,849 | 7/1965 | Maddox | 248/441.1 |
| 3,813,074 | 5/1974 | Mulvaney | 248/452 |
| 4,577,822 | 3/1986 | Wilkerson | 248/463 |
| 4,826,124 | 5/1989 | Kindig | 248/452 |
| 5,290,003 | 3/1994 | Reyes | 248/455 X |

FOREIGN PATENT DOCUMENTS

| | | | |
|---|---|---|---|
| 755740 | 8/1956 | United Kingdom | 248/463 |
| 2234428 | 2/1991 | United Kingdom | 248/441.1 |

*Primary Examiner*—Alvin C. Chin-Shue
*Assistant Examiner*—Derek J. Berger
*Attorney, Agent, or Firm*—Martin Faier

[57] ABSTRACT

A portable flipchart plastic blow molded easel having a display portion telescopically arranged on a pedestal base portion having legs pivotally secured to and foldable away from the base portion for holding the easel upright, the legs and portions having cooperating interconnected means for securing the easel in selected extended or collapsed condition, for table top or floor use and having nesting structure for holding like collapsed easels stacked together during transport and storage.

20 Claims, 6 Drawing Sheets

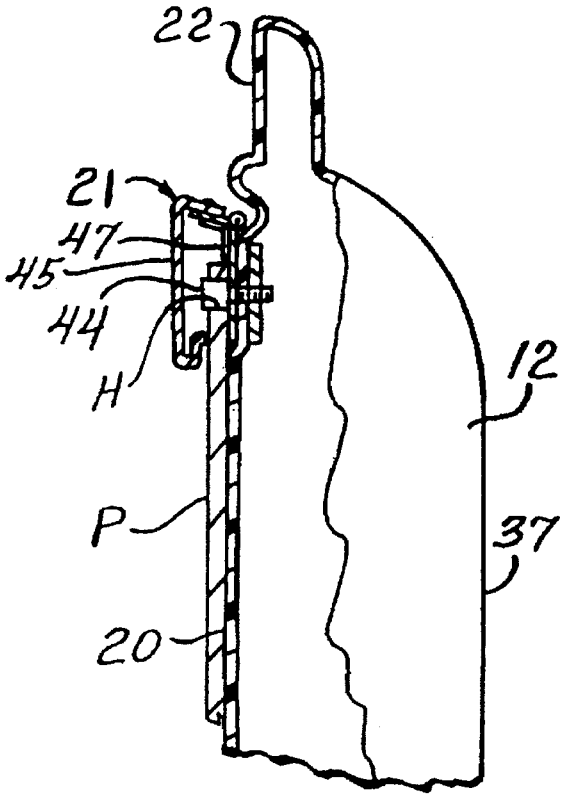
FIG. 14
FIG. 15
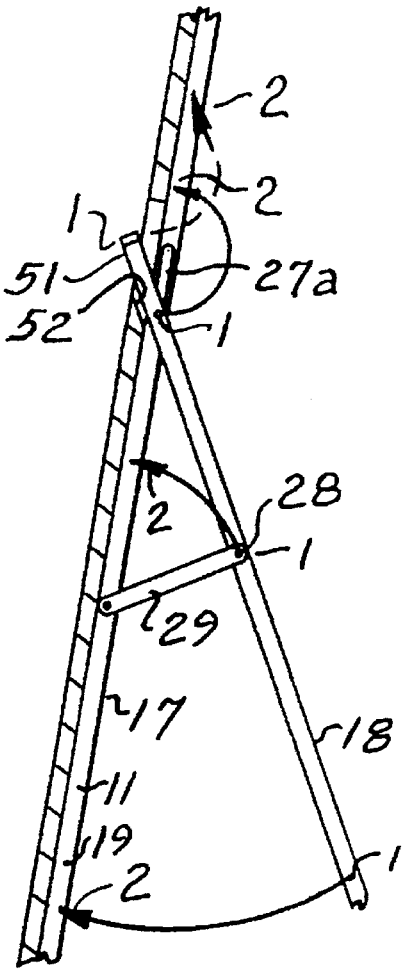

PORTABLE EASEL HAVING A HOLLOW BODY

This is a continuation of application Ser. No. 08/074,773, filed Jun. 9, 1993 now U.S. Pat. No. 5,478,040.

BACKGROUND AND SUMMARY OF THE INVENTION

This invention relates to a portable easel and is more particularly directed to such an easel which may be easily handled, and collapsed for convenient storage and transportation, but which is also sturdy and able to stand up to heavy use and is very durable.

Preferably, an easel embodying the present invention may be blow molded from plastic materials, such as polyethylene plastic, which resists scratches and dents. The easel embodying the present invention comprises a pedestal base portion over which a display portion is slideably telescoped and which may be arranged in selected positions. Each portion is blow-molded into a unitary piece having integral front and rear walls and reinforcing ribs and spacers molding the walls in spaced relation to one another.

This novel easel has built-in leg means for holding the unit upright which may be used to set up the easel into a secured lockable selected position. The device has built into it means for use and storage of writing and display materials, such as markers, tape and the like, and also means for holding standard paper tablets, easel pads, flipcharts and the similar displays, which may be used without fuss.

Construction of the subject easel provides a light weight and strong unit, which is easy to handle and has long life, and folds up into a self-contained unit that is lightweight, balanced and portable. The easel stacks and stores easily, and like devices have interlocking members which provide for easy storage, transport and use. This novel easel may be used on a floor or table, and is fully adjustable for that purpose.

OBJECTS AND ADVANTAGES OF THE INVENTION

It is the object of this invention to provide a novel portable easel of the character recited.

Another object is to provide a pedestal base portion and display portion for an easel which may be collapsed for transport and storage, one portion telescoped within the other portion.

Another object is to provide an easel comprises of a novel base portion and a novel display portion, each portion comprised of integral reinforced spaced apart walls, one portion adapted for being slideably telescoped into the other portion.

Another object is to provide a sturdy but collapsible easel which is simple and quick and efficient to set up and includes novel means for locking the easel in upright position.

Another object is to provide a portable easel having integral compartments for containing easel accessories which may be closed and used for storage and transport of these utensils when not in use.

Another object is to provide novel reinforcing structure for an easel, including guide and ramp means to facilitate easy telescoping and stand-off structure to prevent unintended flexing of the easel sections.

Another object is to provide novel securing means for a flipchart on the display portion of an easel.

Another object is to provide a novel portable easel which may be economically manufactured from resistance materials by blow-molding techniques.

Another object is to provide a novel portable easel which includes a unique holding mechanism for securing a flipchart thereon.

Another object is to provide a novel portable easel which has grasping means and carrying means at its center of gravity when collapsed for convenient set up and transporting of the same.

Another object is to provide multiple easels of the character recited which may be conveniently nested for storage and transport, one interlocked with the other.

Another object is to provide a novel easel structure which includes unique track and channel arrangements for selectively slideably telescopically collapsing and extending the easel structure, while providing reinforcement for the structure.

Another object is to provide positive locking and unlocking means for selectively adjusting and setting up an easel at predetermined positions.

Another object is to provide a novel easel which is simple, efficient and inexpensive to manufacture and use.

These and other objects and advantages of the invention will become more apparent as this description proceeds, taken in conjunction with the accompanying drawings.

BRIEF DESCRIPTION OF THE DRAWINGS

In the drawings:

FIG. 14 is a fractional detail sectional view of the upper part of the display portion of the easel, showing the pad clamp and associated spring clip structure.

FIG. 15 is a detail schematic view of the toggle and leg movement relative to the pedestal base portion of the easel.

DESCRIPTION OF THE PREFERRED EMBODIMENT

With reference to FIGS. 1–5 of the accompanying drawings, the easel 10 has a pedestal base portion 11 and a display portion 12, upon which a pad of paper P may be affixed or indicia placed thereon for display to a group of people in a conference or meeting situation.

Figure 6:
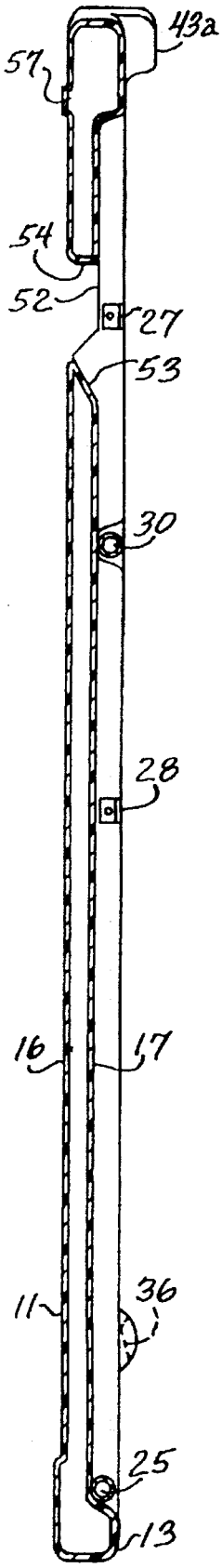
FIG. 6 is a sectional view of the pedestal base portion of the easel taken on line 6—6 of FIG. 4.
Figure 7:
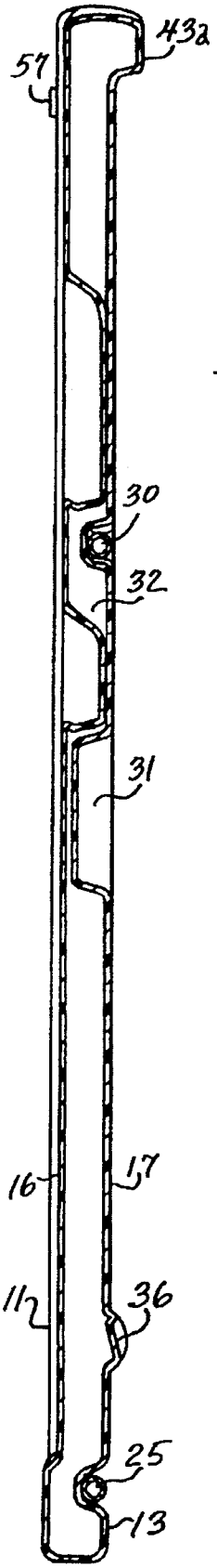
FIG. 7 is another sectional view of the pedestal base portion of the easel taken on line 7—7 of FIG. 4.
Figure 8A:
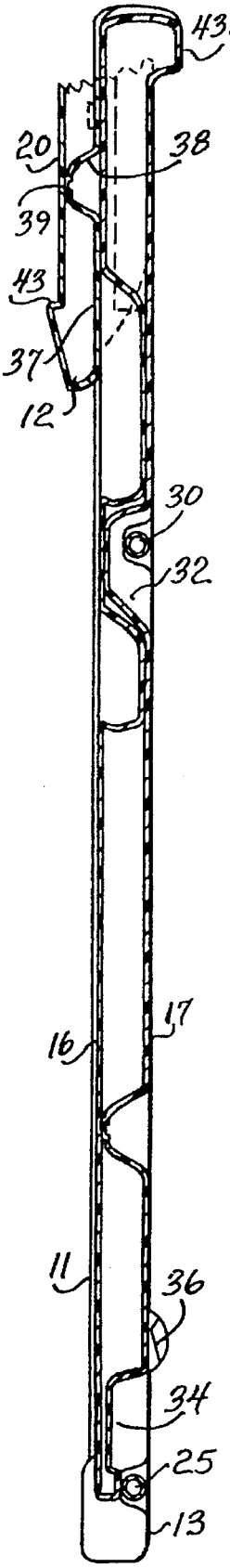
FIG. 8*a* is a sectional view of the easel taken on line 8*a*—8*a* of FIG. 4.
Figure 8B:
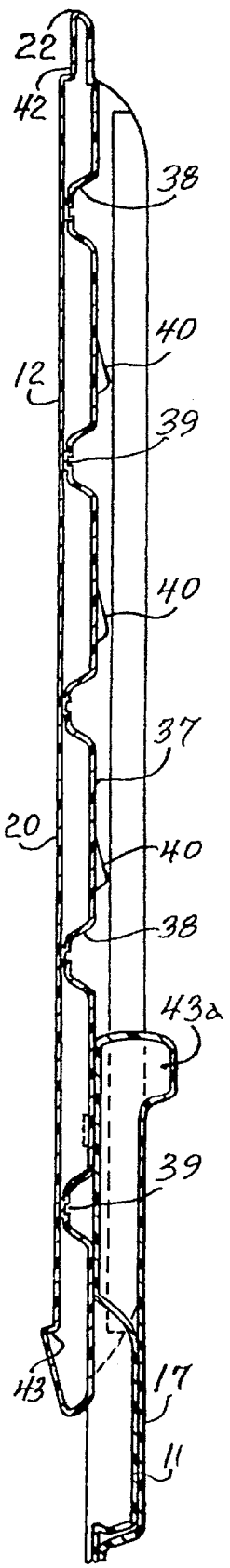
FIG. 8*b* is a sectional view of the easel taken on line 8*b*—8*b* of FIG. 4, said line being a continuation of line 8*a*—8*a* (without the pad clamp).

Preferably, the pedestal base portion 11 has spaced apart feet 13 and upright members 14, which may be bridged by the upper portion thereof defining compartments 15 for holding markers, tape and the like. Telescoped into the pedestal base portion 11, is the display portion 12, and this pedestal base portion has unitary front and rear walls, 16 and 17, respectively (see FIGS. 6 and 7). Legs 18 are arranged and foldable into corresponding grooves 19 on the rear wall 17 of the pedestal base portion 11.

A flat display board 20 is on one face of the display portion 12, and is intended to back up a writing pad P or other display. A spring clamp assembly 21 is secured to an upper edge of the display board 20 so that a pad P may be clipped by the spring clamp assembly to the display board 20 for securing the pad P thereon in a way for pages of the pad to be flipped over the top 22 of the board. Lifting handles 23 may be molded into side edges 24 of the display portion 12 for easy and balanced lifting and collapsing of the display portion relative to the pedestal base portion 11.

The legs 18 are preferably tubular and U-shaped and have a bottom member 25 bridging upright side members 26 which are pivotally secured to the rear wall 17 of the pedestal base portion 11 by means of upper toggle bracket assemblies 27 through short toggle links 27*a*, preferably screw mounted to the rear wall and leg. The side leg members 26 also are secured to the rear wall 17 by lower toggle bracket assemblies 28, preferably also screw mounted to the rear wall and leg, through long toggle links 29, which define arcs for moving the legs 18 toward and away from the pedestal base portion 11 during set up and storage of the easel 10, as shown schematically in FIG. 15, which depict the movement of the legs from position 1 to position 2, and vice versa, in the direction of the respective arrows, as the leg ends 51 are articulated into and out of the apertures 52, in a manner and for a purpose hereafter discussed. Preferably, the leg side members 26 have an integral cross member 30 at the connection of the toggle links 29 to provide rigidity of the structure when set up.

The rear wall 17 of the pedestal base has several recess and protrusions. Recesses 31 provide handles for carry the easel 10 selectively from either side of the easel when collapsed. Recess 32 provides a handle for carry the easel by the leg cross member 30 in an upright position when collapsed. Recess 33 provides rigidity to the pedestal base portion 11 and includes kiss-offs or stress absorbing wells 33*a* for absorbing strain during collapse and extension of the display portion relative to the base portion. Bottom Recess 34 may be used for grasping the legs 18 and pulling them out of the leg recesses during set up. Leg cross member protrusions 35 act as guides for properly seating the leg cross member 30 when the legs are closed against the pedestal base portion in the leg recesses 19. A rounded protrusion 36 having an inverted V shaped cross section is arranged across the lower side of the rear wall and reinforces the wall 17.

With reference to the display portion 12, its rear wall 37 is unitary with the front wall forming the display board 20, the rear wall has a plurality of ribs 38 and stress absorbing wells 39, which stiffen and space apart the front display board 20 and rear wall 37 and absorb stress during extension and collapse of the base and display portions 11 and 12, respectively. On each side of and between the ribs 38, are a plurality of ramps 40 which when the easel is assembled preferably have a steeper taper in the direction of the feet 13 and a relatively more shallow taper in the direction of the top of the display board, and below each of these ramps 40 is a stress absorbing well 41.

A ledge 43 may be provided on the bottom edge of the display board 20 which can act as a lip for balancing a marker when the easel 10 is in use, and this ledge 43 also interlocks with rounded protrusion 36 on the rear wall 17 of the pedestal base portion 11 when collapsed; and the upper face of the board top 22 has a recess 42 which corresponds to a protrusion 43*a* on the rear wall 17 of the pedestal base portion 11. Thus, like easels can be stacked interlocked and be retained in a stack while being transported.

The spring clamp assembly 21 is preferably screw mounted to the front wall of the display board 20 and may have posts 44 having free ends over which drilled hole H in the pad are installed, and this assembly preferably comprises an inverted L shaped clamp plate 45 arranged over the face of the board 20 for holding the upper edge of the pad P and a backer strip 46 which has a spring 47 urging the plate 45 over the pad toward the strip 46.

Figure 9:
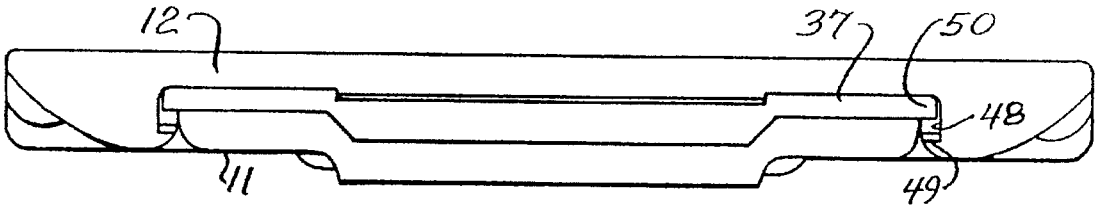
FIG. 9 is a top plan view of the easel shown in FIG. 4 (without the pad clamp).
Figure 10:
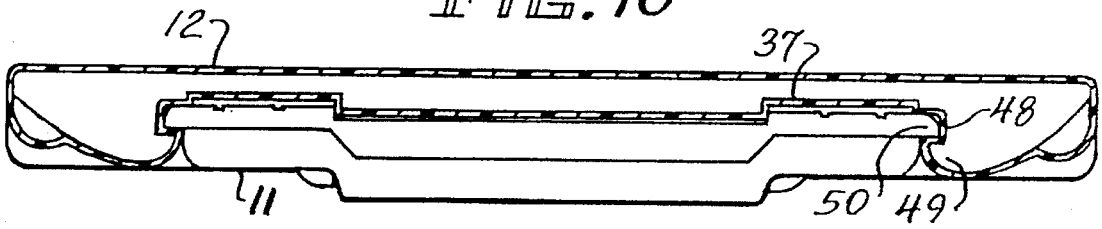
FIG. 10 is a sectional view of the easel taken on line 10—10 of FIG. 4.
Figure 11:
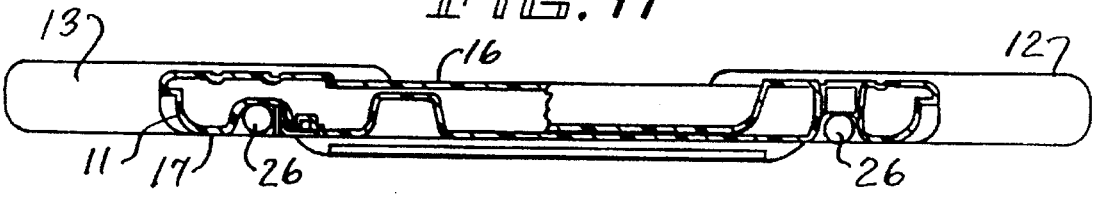
FIG. 11 is a view of the easel taken on line 11—11 of FIG. 4, taken partially in section.

As shown in FIG. 9–11, the rear wall 37 of the display portion 12 is formed with spaced apart vertically arranged tracks 48 and ridges 49, and the pedestal base portion 11 has inside edge member 50 formed corresponding to and interlocking with the tracks 48 and ridges 49 for sliding the display portion 12 upwardly or downwardly along the inside edge members 50 relative to the display portion 12 for elevating or lower the display portion.

Figure 1:
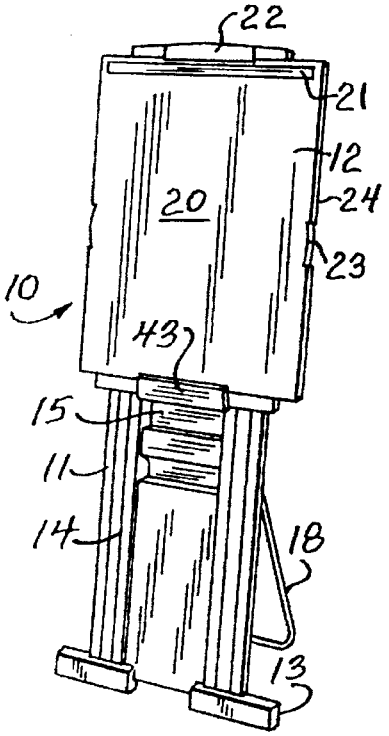
FIG. 1 is a perspective view of an easel embodying the present invention, showing the easel in extended position ready for use.
Figure 2:
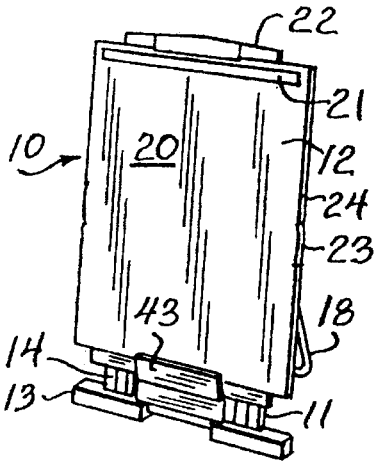
FIG. 2 is a perspective view of the easel shown in FIG. 1, except it has been collapsed for use on a table or for storage or transportation (when the legs are folded against the pedestal base portion).
Figure 3:
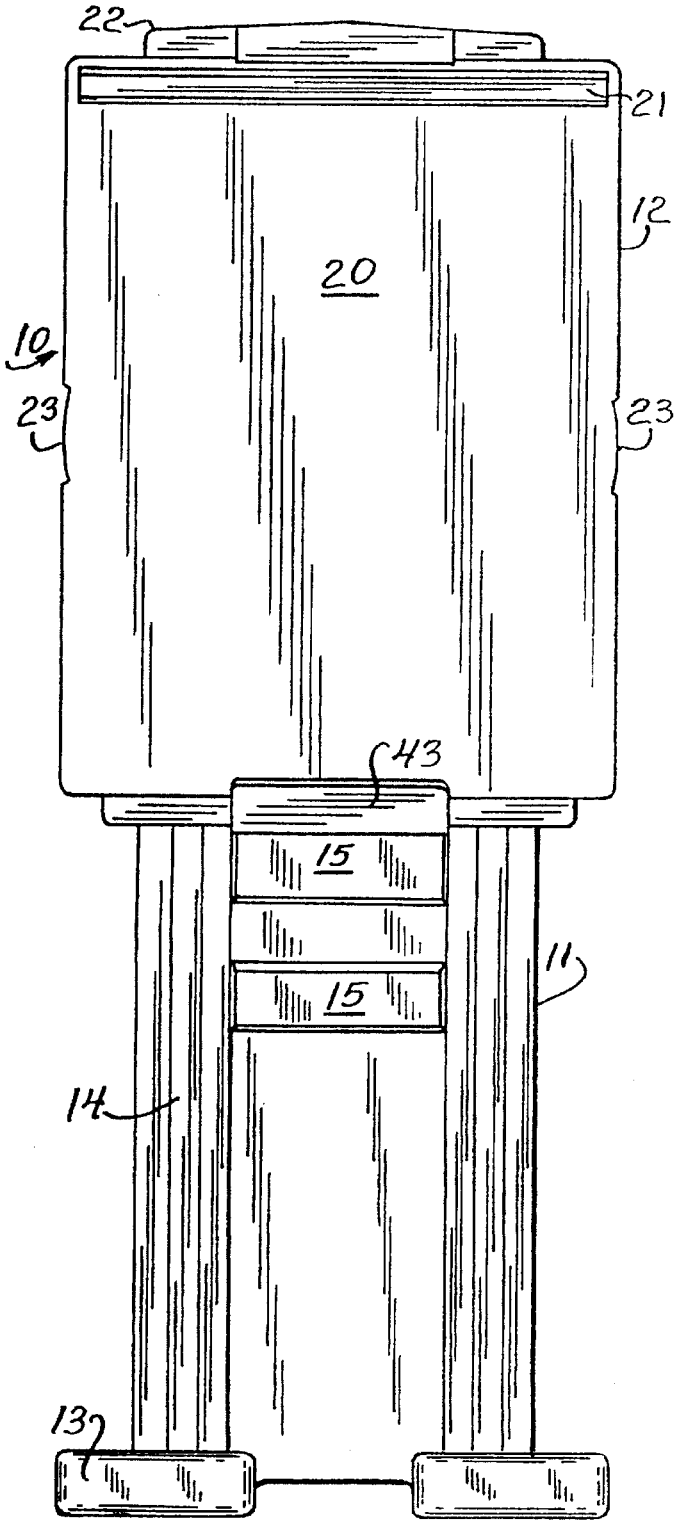
FIG. 3 is an enlarged front elevational view of the easel embodying the invention shown in FIG. 1.
Figure 4:
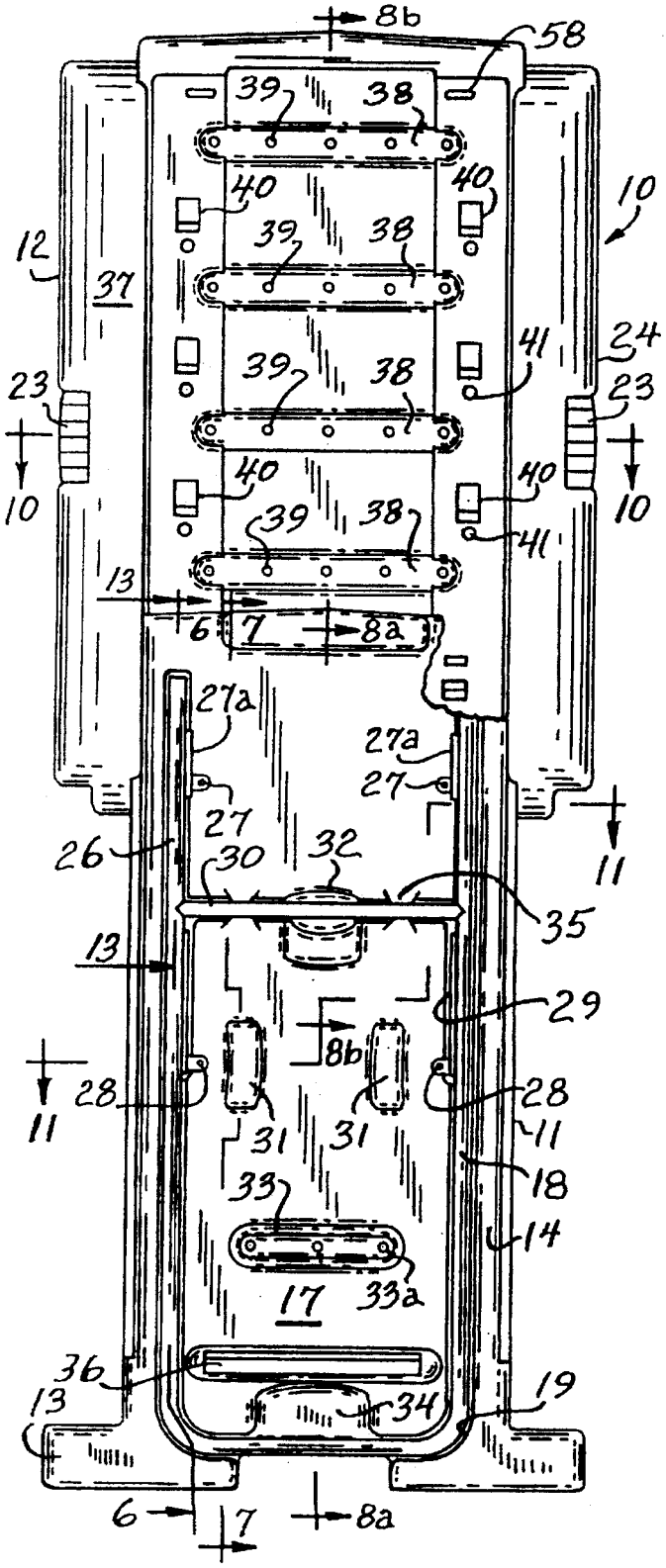
FIG. 4 is a rear elevational view of the easel shown in FIG. 3, with parts of the upper easel section being broken away.
Figure 5:
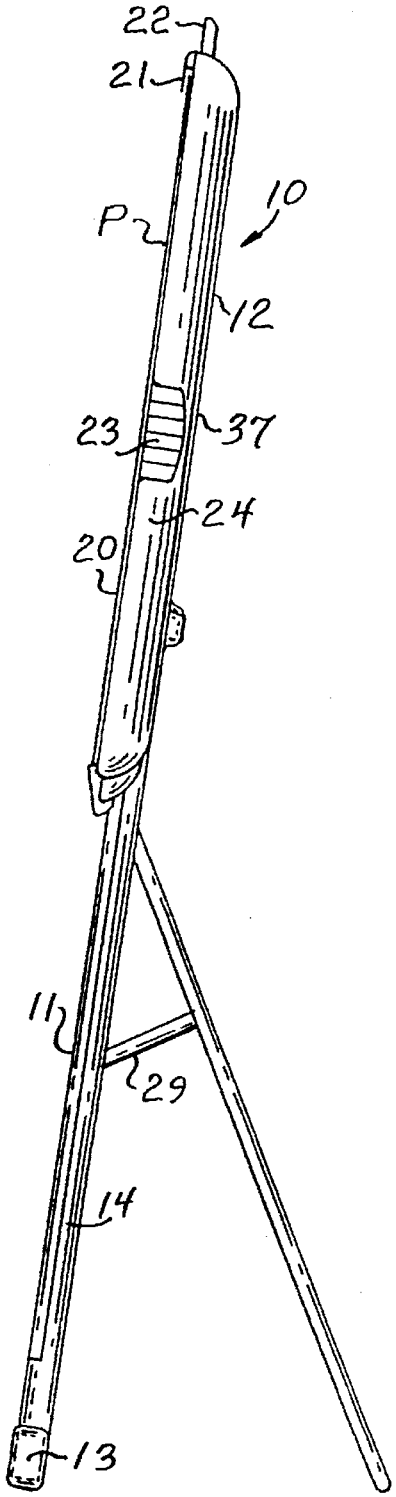
FIG. 5 is a side elevational view of the easel shown in FIG. 3, with the legs extended.
Figure 12:
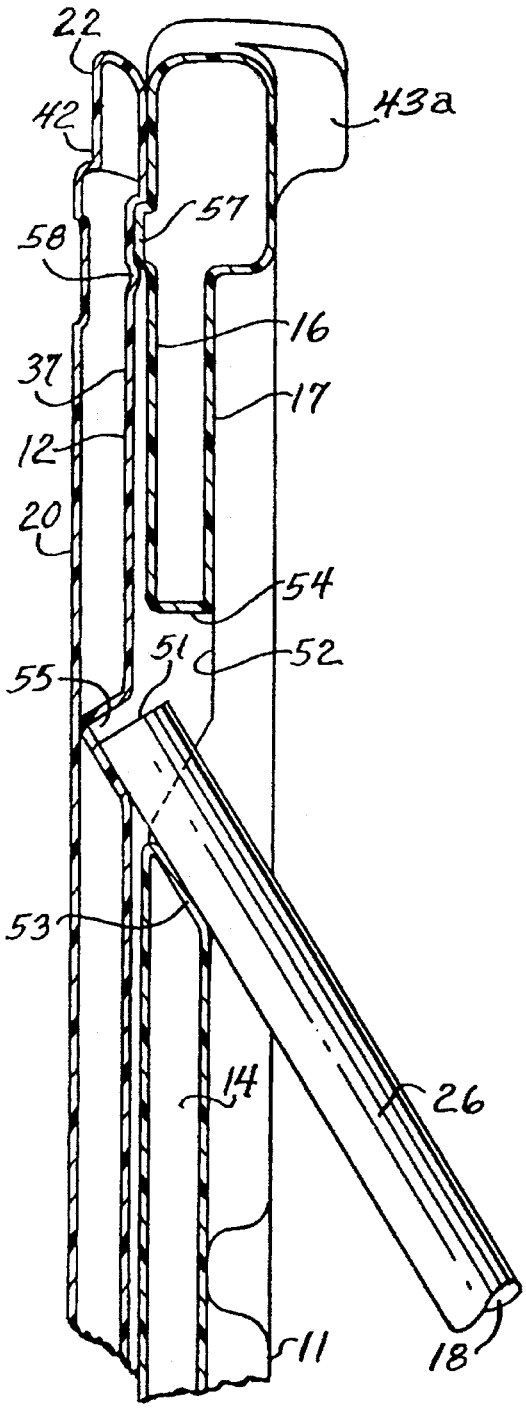
FIG. 12 is a detail sectional view of the leg locking structure for the easel when collapsed for table top use as shown in FIG. 2.
Figure 13:
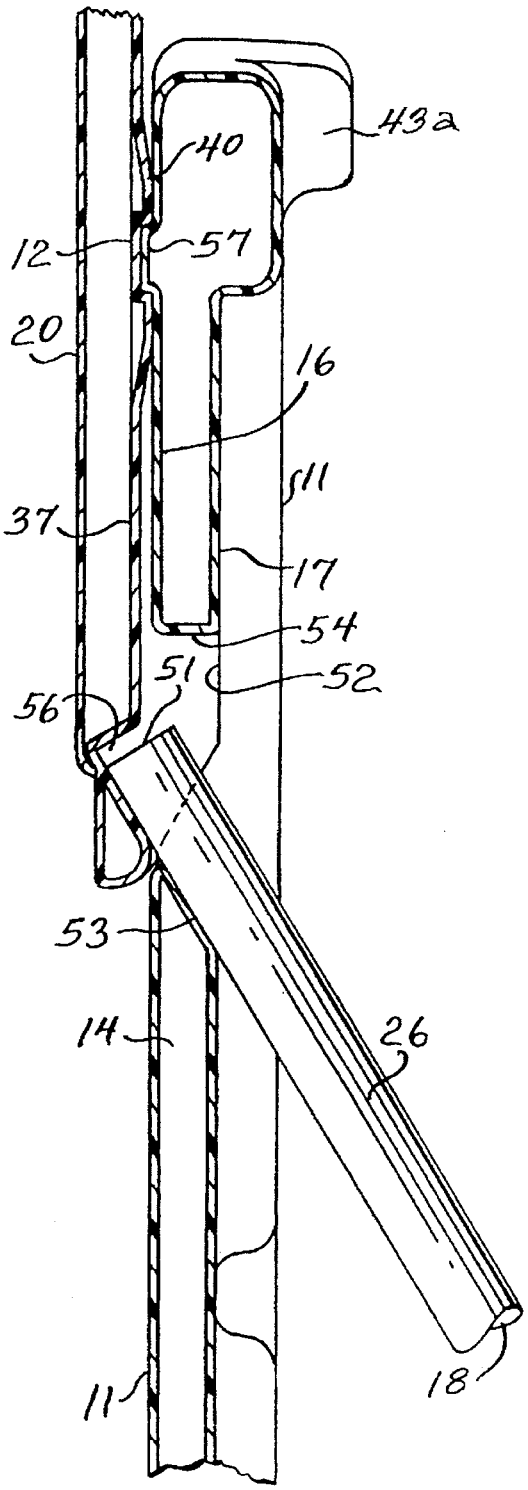
FIG. 13 is a detail sectional view of the leg locking structure similar to FIG. 12, except showing the easel in extended position of FIG. 5, taken on line 13—13 thereof.

With reference to FIGS. 12 and 13, means is provided for securing the display portion 12 relative to the pedestal base portion 11, either in extended floor mounted position as shown in FIG. 1 or in telescoped table mounted position shown in FIG. 2, respectively. In either position, the legs 18 are articulated, by the toggle links 27*a* and 29 held by upper and lower brackets 27 and 28, respectively, when folded away from the pedestal base portion 11 (see FIG. 15), in position as shown in FIGS. 12 or 13, so that the ends 51 of the leg side members 26 obliquely extend through an aperture 52 through the pedestal base portion 11 and come to rest against an angularly tapered wall 53 of the aperture clearing upper wall 54.

The rear wall 37 of the display portion 11 has formed in it two sets of wedge shaped notches, one set arranged near the top 55 and the other set arranged near the bottom 56 of the display portion rear wall 37, each vertically and horizontally aligned, for receiving the leg ends 51, thus locking the display portion relative to the base portion selectively in the table top position shown in FIG. 12 (using the top set 55 of notches) or the floor position shown in FIG. 13 (using the bottom set 56 of notches).

In addition to the ramps 40 previously described for slowing down the movement of the display portion 12 as it slides downwardly on the pedestal base portion 11, bars 57 may be formed on the front wall 16 of the base portion, above the apertures 52, and corresponding bumps 58 may be formed in the rear wall 37 of the display portion to restrict the movement of the display portion 12 downwardly on the base portion 11 and to help hold the portions in position once adjusted, as shown in FIGS. 12 and 13.

Also, when the display portion 12 is telescoped downwardly over the base pedestal portion 11 in the manner described, the compartments 15 are closed and covered by the display portion. Thus, materials stored in these compartments may be safely stored, transported and reused when the easel are needed again.

Normally, easels 10 are stored in the position shown in FIG. 2, except the legs 18 are folded against the leg recess 19, laid horizontally stacked one easel upon the next easel, so that they interlock, as described, for stability. The upper easel is removed from the pile, and its display portion 12 may be extended, as shown in FIG. 1, if used on a floor, or telescoped, if used on a table, as shown in FIG. 2, with the legs folded away from the pedestal base 11 and in interlocked position with the display portion 12, as shown in FIGS. 12 and 13, respectively. A change from floor mount to table mount, or vice versa, may be easily accomplished, by slightly folding the leg ends 51 to clear the notches 55 or 56, moving the board 20 upwardly or downwardly, and re-locking the leg ends into the corresponding notches.

While a preferred embodiment of the novel easel has been shown, many variations and changes may be made in the structure, without departing from the spirit or scope of the invention. Accordingly it is not desire that the invention should be limited to the exact construction described.

We claim:

1. A portable easel comprising a base pedestal portion having leg means pivotally mounted on and foldable toward and away from said base pedestal portion for securing said base pedestal portion upright on a surface;

a display portion telescopically engaged with said base pedestal portion and having means for removably securing thereon display materials;

said portions being movable relative to one another into extended and collapsed positions;

said portions having cooperating interlocking means for securing said portions in one of a plurality of selected positions when said leg means are pivoted and folded away from said base pedestal portion;

at least one of said portions comprising a hollow body having spaced apart walls, said walls having reinforcing recesses and wall surfaces arranged to provide rigidity across said body.

2. The easel recited in claim 1, wherein said portions are each formed of unitary blow molded plastic material.

3. The easel recited in claim 1, wherein said portions have means for interlocking like easels, one stacked upon another easel for transportation and storage.

4. The easel recited in claim 1, wherein said interlocking means has an aperture through said pedestal base portion and notches aligned with said aperture in said display portion.

5. The easel recited in claim 4, wherein said interlocking means has articulating means for moving a part of said leg means through said apertures and into a corresponding notch to secure said portions in selected position.

6. The easel recited in claim 1, wherein said base pedestal portion has integral handle means which may be grasped when said easel is in collapsed condition.

7. The easel recited in claim 1, wherein said hollow portion has rib and well means to reinforce said portion.

8. The easel recited in claim 1, wherein said display portion has a flat board surface on a side opposed to the leg means on said base pedestal portion.

9. The easel recited in claim 8, wherein the edges of said display portion intermediate said board surface have opposed gripping handles for telescoping said portions into extended and collapsed condition.

10. The easel recited in claim 8, wherein one edge of said board surface has a clamp assembly for securing display materials to said surface.

11. The easel recited in claim 10, wherein said clamp assembly has a post element for securing a drilled pad to said surface.

12. The easel recited in claim 10, wherein said clamp assembly comprises a clip member arranged over a backer strip for holding said display material in position.

13. The easel recited in claim 12, wherein said clamp assembly has a spring member interspaced between said clip member and backer strip for urging said clip member against said board surface.

14. The easel recited in claim 1 wherein said pedestal base portion has integral compartments which are open when said portions are extended and closed when said portions are in collapsed position.

15. The easel recited in claim 1, wherein said base pedestal portion and said display portion both comprise hollow bodies having space apart walls with reinforcing recesses and wall surfaces arranged to provide rigidity across each of said bodies.

16. The easel recited in claim 1, wherein said hollow body has finished edges.

17. A portable easel comprising a base pedestal portion having leg means mounted thereon movable for securing said base pedestal portion upright on a surface;

a display portion engaged with said base pedestal portion and having means for removably securing thereon display materials;

said portions being movable relative to one another into extended and collapsed positions;

said portions having cooperating interlocking means for securing said portions in one of a plurality of selected positions;

said portions each comprising a hollow body having spaced apart walls closed at their edges, said walls having reinforcing recesses and wall surfaces arranged to provide rigidity across said body.

18. The easel recited in claim 17, with the addition of members associated with said leg means for holding said easel upright in selected extended or collapsed position.

19. The easel recited in claim 18, wherein said leg means are associated with said interlocking means and removably secure said portions together when in selected position.

20. The easel recited in claim 17, with the addition of ramp and bar means on said portions for restricting movement of said display portion relative to said base portion during movement of said portions in one direction but which do not interfere with movement of said portions in an opposed direction.

* * * * *